United States Patent [19]

Beyer et al.

[11] Patent Number: 4,897,310

[45] Date of Patent: Jan. 30, 1990

[54] INKING RIBBON FOR TRANSFERRING COLOR UNDER THE INFLUENCE OF HEAT

[75] Inventors: Wolfgang Beyer; Monika Kohla; Manuela Schneider; Eduard Schuetz, all of Berlin, Fed. Rep. of Germany

[73] Assignee: Siemens Aktiengesellschaft, Berlin and Munich, Fed. Rep. of Germany

[21] Appl. No.: 280,818

[22] Filed: Dec. 7, 1988

[30] Foreign Application Priority Data

Dec. 15, 1987 [DE] Fed. Rep. of Germany ..... 3742924
May 20, 1988 [DE] Fed. Rep. of Germany ..... 3817753

[51] Int. Cl.[4] ..... B41M 5/26

[52] U.S. Cl. ..... 428/412; 428/195; 428/480; 428/481; 428/484; 428/532; 428/913; 428/914

[58] Field of Search ..... 428/195, 484, 488.1, 428/480, 526, 913, 914, 411.1, 412, 481, 532, 488.4

[56] References Cited

U.S. PATENT DOCUMENTS 4,491,432 1/1985 Aviram et al. ..... 428/913
4,525,722 6/1985 Sachdev et al. ..... 428/913

FOREIGN PATENT DOCUMENTS 0150383 8/1985 European Pat. Off. ..... 428/195
1075136 10/1954 France ..... 428/195

OTHER PUBLICATIONS

Chemical Abstracts, vol. 79, No. 19, Nov. 12, 1973, p. 341, No. 131371a.
T. Urbanski, *Chemistry and Technology of Explosives,* vol. 2, 1985, pp. 307–313.
Japanese Patent Reports, vol. 75, No. 25 (A89) (G8), Jul. 14, 1975.
Glafkides, "Chimie et Physique Photographiques", pp. 504–506.
Patent Abstracts of Japan, vol. 9, No. 18 (M-353) [1741] Jan. 25, 1985.
IBM Technical Disclosure Bulletin, vol. 19, No. 2, Jul. 1976, p. 672.
Chemical Abstracts, vol. 102, 1985, p. 514 102:103652t.

*Primary Examiner*—Pamela R. Schwartz
*Attorney, Agent, or Firm*—Hill, Van Santen, Steadman & Simpson

[57] ABSTRACT

An inking ribbon for transferring color under the influence of heat. The inking ribbon including a carrier layer, an ink layer, and a decomposable component that promotes the transfer of the color upon the application of heat. The decomposable component is cellulose nitrate, the decomposition temperature of the cellulose nitrate is variable in the range between 100° C. and 150° C. with catalytic additives.

14 Claims, 1 Drawing Sheet

INKING RIBBON FOR TRANSFERRING COLOR UNDER THE INFLUENCE OF HEAT

BACKGROUND OF THE INVENTION

The present invention is directed to an inking ribbon for transferring color, under the influence of heat, comprising a carrier layer, an ink (or color) layer, and an exothermally decomposable component that promotes the transfer of the color when heat is applied.

European Patent Application No. EP-A-0 150,383 discloses an inking ribbon. In the inking ribbon disclosed, an ink layer, applied on a carrier layer, contains an aromatic azido compound that exothermally decomposes with a reaction temperature in the range from 170° C. through 200° C. given the application of heat with a thermal printing head and thereby supplies additional heat for softening the ink layer.

U.S. Pat. No. 4,525,722 discloses a heat-sensitive inking ribbon having hydrazone derivatives as an exothermally decomposable component in the ink layer, or as an intermediate layer between the carrier layer and the ink layer. The decomposition temperature of the exothermally decomposable component lies in the range of between 150° C. and 200° C. The patent specifies 200 J/g as the typical value of the specific energy being thereby released.

JP-A-59 165690 (Patent Abstracts of Japan, Vol. 9, No. 18 (M-353) (1741), 25 Jan. 1985), as well as, "IBM Technical Disclosure Bulletin", Vol. 19, No. 2, July 1976, page 672, disclose the use of cellulose nitrate (also known as "nitrocellulose") as an adhesion promotor between the carrier layer and the ink of a heat-sensitive inking ribbon. The cellulose nitrate therein, however, only functions to promote adhesion and is not exothermally reactive.

SUMMARY OF THE INVENTION

The present invention provides an inking ribbon comprising an exothermally decomposable component. The present invention further lowers the decomposition temperature and thereby increases the energy released, achieving a further reduction in the drive energy for printing with the inking ribbon.

To this end, the present invention provides an inking ribbon for transferring color under the influence of heat, comprising a carrier layer, an ink layer, and a decomposable component that promotes the color transfer given the application of heat. The decomposable component is composed of cellulose nitrate having a decomposition temperature set in the range of between approximately 100° C. to about 150° C. with catalytic additives.

In an embodiment of the present invention, the inking ribbon includes a heat-meltable ink layer and the cellulose nitrate is contained in the ink layer as a component thereof.

In an embodiment of the present invention, the inking ribbon includes a release layer located between the ink layer and the carrier layer, the release layer being composed of cellulose nitrate.

In an embodiment of the present invention, the cellulose nitrate contains approximately 1 to about 20 weight percent amido sulfonic acid as the catalytic additive.

In an embodiment of the present invention, the cellulose nitrate contains approximately 1 to about 20 weight percent toluol-4-sulfonic acid as the catalytic additive.

A significant advantage of the inking ribbon of the present invention is that the cellulose nitrate explosively decomposes in the region of the printing zone given a local heating of the inking ribbon. Accordingly, the cellulose nitrate thereby supplies additional heat for the softening of the ink layer and also effects a firm bonding of the ink on the recording medium to be printed. The additional heat is due to the gases that are explosively released when the cellulose nitrate decomposes.

Depending on the respective degree of nitration of the cellulose nitrate the energy that is released, given the local, exothermic decomposition of the cellulose nitrate, lies on the order of that for standard explosives such as TNT or nitroglycerine. The kinetic energy of the gases that are released upon the decomposition, impresses the ink deeply into the recording medium and thereby particularly fills surface depressions of the recording medium. As a result of the catalytic additives, the decomposition temperature, i.e., the temperature threshold at which the decomposition of the cellulose nitrate begins, first lies clearly above the normal ambient temperature and above the operating temperature of a printer but, second, the printing temperature required for printing and, thus, the required drive energy for a thermal printing head are comparatively low.

In an embodiment, the inking ribbon of the present invention has a release layer located between the ink layer and the carrier layer. The release layer is constructed from cellulose nitrate that has its decomposition temperature set with the catalytic additives. The high specific decomposition energy of the cellulose nitrate has the advantage of allowing the release layer to be extremely thin. The cellulose nitrate itself forms the stripping layer and does not require any additional polymer as a bonding agent. An especially sharp print face is thereby achieved in the thermal transfer printing because—due to the thin stripping layer—the local decomposition region thereof is defined with especially sharp edges with reference to the heating region of the printing zone with, for example, heating elements of the thermal printing head or with a heat radiation source A further advantage is achieved in that the stripping layer completely decomposes in the region of its local heating. Accordingly, the ink transferred onto the recording medium will no longer stick to the inking ribbon thereafter. It is therefore also not absolutely necessary to detach the inking ribbon from the recording medium immediately following the printing zone. Accordingly, thermal printing heads that are only constructed for use with inking ribbons without a release layer can also be used in combination with the inking ribbon of the present invention. Finally, the release layer composed of cellulose nitrate can be very easily applied on the carrier layer from a solution in the manufacture of the inking ribbon of the present invention.

The catalytic additives useful in the present invention can include metal salts and/or organic acids. In an embodiment, as the catalytic additive, the cellulose nitrate preferably contains approximately 1 to about 20 percent by weight amido sulfonic acid, whereby the decomposition temperature of the cellulose nitrate is significantly lowered from about 180° C. through 190° C. to about 130° C. through 140° C. An even further lowering of the decomposition temperature, to about 110° C. through 130° C., can be achieved by utilizing approximately 1 to about 20 weight percent of toluol-4-sulfonic acid are as the catalytic additive in the cellulose nitrate.

Additional features and advantages of the present invention will be apparent from the detailed description of the presently preferred embodiments and from the drawings.

DETAILED DESCRIPTION OF THE PRESENTLY PREFERRED EMBODIMENTS

The present invention provides an inking ribbon for transferring color upon the application of heat. The inking ribbon includes a carrier layer and a decomposable component that promotes the color transfer upon the application of heat. The decomposable component is composed of cellulose nitrate having a decomposition temperature set in the range of between approximately 100° C. to about 150° C. with catalytic additives.

Figure 1:
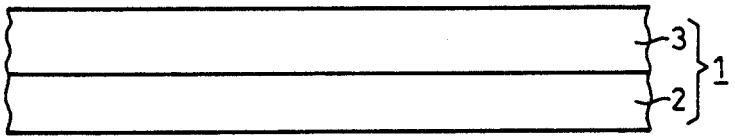
FIG. 1 illustrates a cross-sectional perspective view of an inking ribbon of the present invention.

Referring to FIG. 1, an embodiment of the inking ribbon 1 of the present invention is illustrated. The inking ribbon includes a carrier layer 2, that can be composed of, for example, polyethylene terephthalate or of polycarbonate. An ink layer 3 is applied on the carrier layer 2. The ink layer 3 contains pigments bonded in waxes and/or thermoplastics and includes cellulose nitrate that functions as the exothermally decomposable component.

The decomposition temperature of the cellulose nitrate is adapted to the heating capacity of the different types of printers in which the inking ribbon 1 of the present invention is to be utilized. To this end, the decomposition temperature of the cellulose nitrate is adapted with catalytic additives. The catalytic additives can include, for example, organic acids and/or metal salts. In an embodiment, approximately 1 to about 20 weight percent, preferably approximately 5 to about 10 weight percent amido sulfonic acid, also known as amino sulfuric acid, sulfamine acid, or toluol-4-sulfonic acid, also known as paratoluol sulfonic acid, is added to the cellulose nitrate as a catalytic additive. The catalytic additives reduce the decomposition temperature of the cellulose nitrate to approximately 130° to about 140° C. or, respectively, approximately 110° C. to about 130° C., whereby the thermal energy being released as a function of the temperature proceeds very sharply and with steep edges given catalyst concentrations below 10 percent and proceeds more flatly given higher catalyst concentrations.

The specific heat quantity and quantity of gas that is released upon the decomposition of the cellulose nitrate is dependent on the selected nitration degree of the cellulose nitrate that amounts to between approximately 10.9 percent to about 12.2 percent. The specific decomposition energy achieved is between approximately 500 J/g to about 2000 J/g. Accordingly, it lies far beyond the values recited in U.S. Pat. No. 4,525,722 for the hydrazone derivatives. The quantity of gas that is released amounts to up to 70 percent of the quantity of the cellulose nitrate.

For printing an image pattern on a recording medium (not illustrated), the side of the inking ribbon 1 formed by the carrier layer 2 is locally heated to a temperature above the decomposition temperature of the cellulose nitrate with the catalytic additives. The side can be locally heated by the heating elements of a thermal printing head or of a heat radiation source (laser). The cellulose nitrate explosively decomposes at the heating location and releases additional heat and gases ($CO_2$, CO, $N_2$, $H_2$). The additional heat effects a melting of the ink layer S whereas the gases that are released bold the melted ink particles to the recording medium lying against the ink layer through the high kinetic energy.

Figure 2:
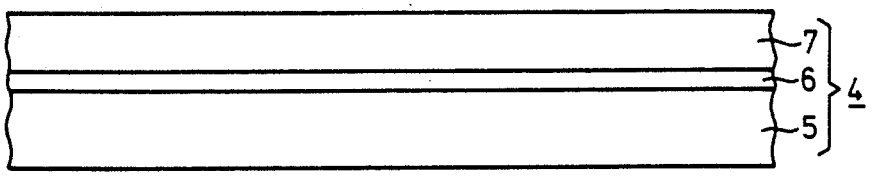
FIG. 2 illustrates a cross-sectional perspective view of another embodiment of the inking ribbon of the present invention.

Referring now to FIG. 2, an embodiment of the inking ribbon of the present invention is illustrated. The inking ribbon 4 illustrated comprises a carrier layer 4 that, for example, can be composed of polyethylene terephthalate or of polycarbonate. The carrier layer 5 carries a release layer 6 that is composed of cellulose nitrate. The cellulose nitrate can be applied from an organic solution such as, for example, butylacetate, ethylacetate, or acetone.

The decomposition temperature of the release layer, as set forth above for the embodiment illustrated in FIG. 1, can also be varied by catalytic additives such as, for example, acids or metal salts and adapted to the heating capability of the various types of printers in which the inking ribbon 4 is used. The heat quantity and gas quantity that are released upon the decomposition of the release layer 6 are dependent on the selected nitration degree of the cellulose nitrate. The ink layer 7 adheres to the release layer 5. The recording medium to be printed in the thermal transfer printing lies against the ink layer 7 and is conducted past a thermal printing head or a heat radiation source upon interposition of the inking ribbon 4. The ink layer 7 contains pigments bonded in waxes and/or thermoplastics.

For printing an image pattern, that side of the inking ribbon 4 formed by the carrier layer 5 is locally heated to a temperature above the decomposition temperature of the release layer 6. The side is locally heated with heating elements of the thermal printing head or of a heat radiation source. At this location, the release layer 6 decomposes explosively emitting additional heat and releasing gases ($CO_2$, CO, $N_2$, $H_2$). The additional heat effects a melting of the layer 7. The gases that are released bond the melted ink particles to the recording medium lying against the ink layer 7 via high kinetic energy. Since the release layer 6 decomposes nearly completely in the region in which it is heated, the ink released in this region will no longer stick to the inking ribbon 1 after the printing zone has cooled. Therefore, a faultless transfer of the ink onto the recording medium is insured.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

We claim:

1. An inking ribbon for transferring color through the application of heat comprising:

a carrier layer;

an ink layer;

a decomposable component that promotes the color transfer given the application of heat, composed of cellulose nitrate whose decomposition temperature is set at between approximately 100° C. to about 150° C. with catalytic additives; and the ink layer being heat-meltable and the cellulose nitrate being contained in the ink layer as a component thereof.

2. The inking ribbon of claim 1 wherein the cellulose nitrate contains approximately 1 to above 20 weight percent amido sulfonic acid as catalytic additive.

3. The inking ribbon of claim 1 wherein the cellulose nitrate contains approximately 1 to about 20 weight percent toluol-4-sulfonic acid as catalytic additive.

4. An inking ribbon for transferring color through the application of heat comprising:

a carrier layer;

an ink layer;

a decomposable component that promotes the color transfer give the application of heat, composed of cellulose nitrate whose decomposition temperature is set at between approximately 100° C. to about 150° C. with catalytic additives; and including a release layer located between the ink layer and the carrier layer, the release layer being composed of the cellulose nitrate with catalytic additives.

5. The inking ribbon of claim 4 wherein the cellulose nitrate contains approximately 1 to about 20 weight percent amido sulfonic acid as catalytic additive.

6. The inking ribbon of claim 4 wherein the cellulose nitrate contains approximately 1 to about 20 weight percent toluol-4-sulfonic acid as catalytic additive.

7. An inking ribbon for transferring color through the application of heat comprising:

a carrier layer;

an ink layer; and a decomposable component located in the ink layer that promotes the color transfer upon the application of heat the decomposable temperature is set at between approximately 100° C. to about 150° C. with catalytic additives chosen from the group consisting of metal salts and organic acids.

8. The inking ribbon of claim 7 wherein the cellulose nitrate contains approximately 1 to about 20 weight percent amido sulfonic acid as catalytic additive.

9. The inking ribbon of claim 7 wherein the cellulose nitrate contains approximately 1 to about 20 weight percent toluol-4-sulfonic acid as catalytic additive.

10. The inking ribbon of claim 7 wherein the carrier layer is composed of a compound chosen from the group consisting of polyethylene terephthalate and polycarbonate.

11. An inking ribbon for transferring color through the application of heat comprising:

a carrier layer;

an ink layer; and a release layer located between the carrier layer and ink layer, the release layer being composed of a cellulose nitrate whose decomposition temperature is set at between approximately 100° C. to about 150° C. with catalytic additives chosen from the group consisting of metal salts and organic acids.

12. The inking ribbon of claim 11 wherein the cellulose nitrate contains approximately 1 to about 20 weight percent amido sulfonic acid as catalytic additive.

13. The inking ribbon of claim 11 wherein the cellulose nitrate contains approximately 1 to about 20 weight percent toluol-4-sulfonic acid as catalytic additive.

14. The inking ribbon of claim 11 wherein the carrier layer is composed of a compound chosen from the group consisting of polyethylene terephthalate and polycarbonate.

* * * * *